US006056066A

United States Patent [19]

Wells et al.

[11] Patent Number: 6,056,066

[45] Date of Patent: May 2, 2000

[54] SOIL REGENERATION APPARATUS AND METHOD

[75] Inventors: Larry G. Wells; John P. Fulton, both of Lexington, Ky.

[73] Assignee: University of Kentucky Research Foundation, Lexington, Ky.

[21] Appl. No.: 09/015,395

[22] Filed: Jan. 29, 1998

[51] Int. Cl.[7] ..... E01H 5/06; E02F 3/76

[52] U.S. Cl. ..... 172/71; 37/389; 172/815

[58] Field of Search ..... 172/71, 815; 37/254, 37/350, 389, 257, 212, 228, 272, 273, 274, 281

[56] References Cited

U.S. PATENT DOCUMENTS

| | | | |
|---|---|---|---|
| 864,151 | 8/1907 | Blaisdell | 37/257 X |
| 1,508,716 | 9/1924 | Ochs | 37/257 X |
| 1,563,975 | 12/1925 | Goeringer | 37/142.5 |
| 2,646,736 | 7/1953 | Swartout | 37/257 X |
| 3,091,873 | 6/1963 | West | 37/142.5 X |
| 3,375,878 | 4/1968 | Dorn | 37/257 X |
| 3,503,450 | 3/1970 | Day | 37/142.5 X |
| 3,841,410 | 10/1974 | Nikitin et al. | 37/142.5 X |
| 4,185,698 | 1/1980 | Frisbee | 172/71 |
| 4,356,645 | 11/1982 | Hine et al. | 172/815 X |
| 4,369,847 | 1/1983 | Mizunuma | 172/815 |
| 4,614,048 | 9/1986 | Melby | 172/815 X |
| 4,864,748 | 9/1989 | Boyer | 37/142.5 |
| 5,242,246 | 9/1993 | Manchak, III et al. | 405/128 |
| 5,638,618 | 6/1997 | Niemela et al. | 172/815 X |
| 5,819,444 | 10/1998 | DesMarais | 172/815 X |
| 5,848,654 | 12/1998 | Belcher, Jr. | 172/815 |

*Primary Examiner*—Christopher J. Novosad
*Attorney, Agent, or Firm*—King and Schickli

[57] ABSTRACT

An apparatus for regenerating compacted soil in reclaim surface mining lands is provided. The apparatus includes an auger rotatably mounted above and forward of the blade of an earthmover, such as a bulldozer. The auger is longer than the blade and is mounted such that it extends substantially beyond one side of the blade. Adjacent this extension, a controllable lateral baffle is mounted for selectively adjusting a transverse dimension of the blade. In operation, compacted soil is collected by the blade until it reaches the auger. The auger then decompacts, transversely displaces, and deposits the soil relative to the blade, thereby creating a decompacted rooting layer that is ideal for planting. The lateral baffle may be selectively adjusted during operation to control the level of deposition of decompacted soil to provide a substantially level berm. A method of soil regeneration using the apparatus of the present invention is also disclosed.

17 Claims, 4 Drawing Sheets

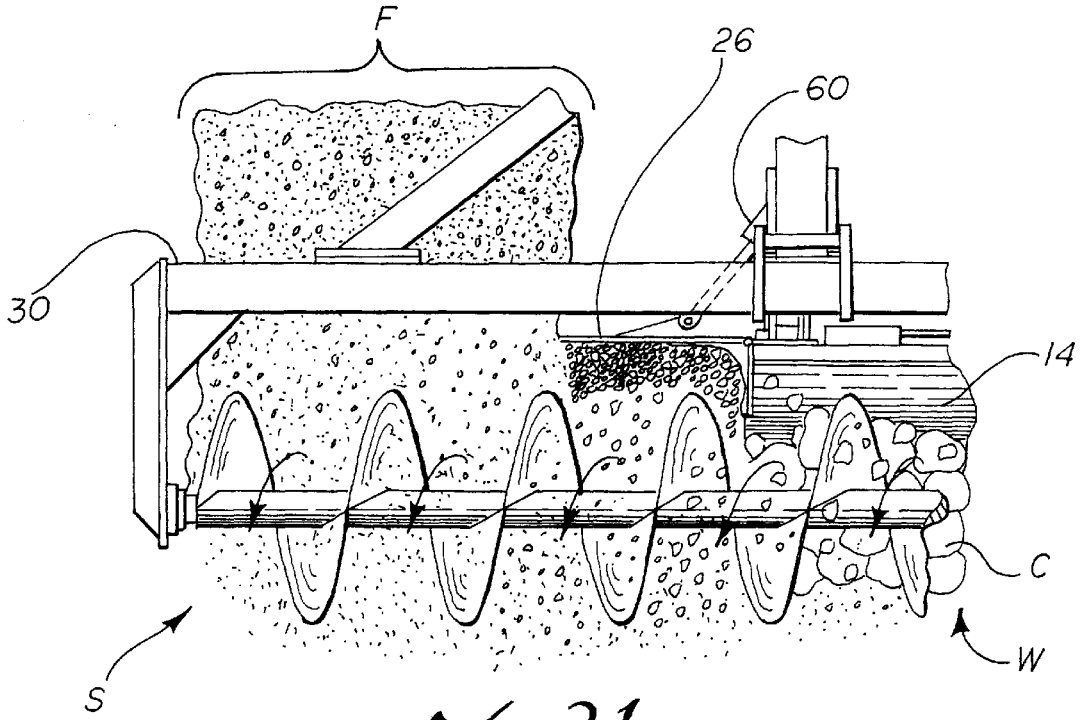
Fig. 4a
Fig. 4b
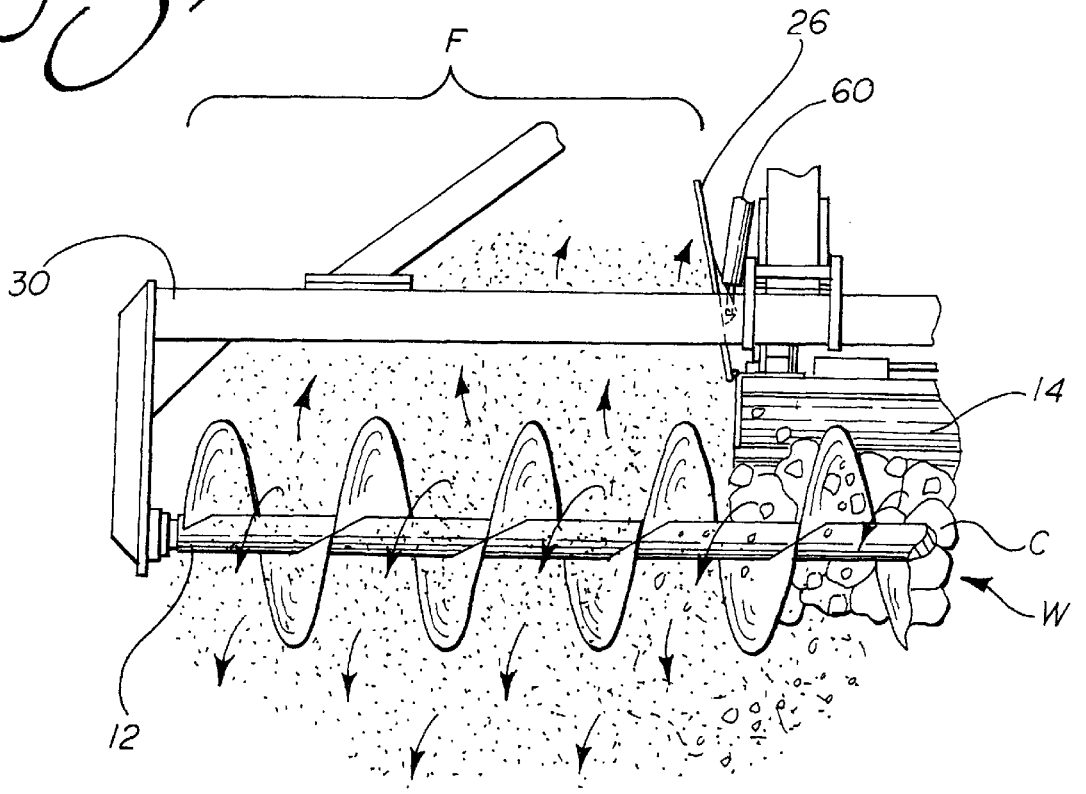

SOIL REGENERATION APPARATUS AND METHOD

TECHNICAL FIELD

The present invention relates generally to earthmoving and, more particularly, to an improved apparatus and method for decompacting soil with particular application to land reclamation operations.

BACKGROUND OF THE INVENTION

Surface mining is commonly employed to extract valuable minerals and ores from the earth. In surface mining, the uppermost layers of earth are cut open and removed, or "stripped," in order to expose underlying seams of valuable minerals such as coal or the like. After the seams are mined, the land must then be returned to productive use, or "reclaimed."

Post-mining land reclamation generally involves: (1) replacing the removed minerals and subsurface rock with the spoil from the excavation; (2) grading this spoil; and (3) redepositing earth, or more specifically, soil, over this graded spoil. Vegetation is then replanted in the uppermost layer of soil to restore the land to a useful state.

It is well-known that one of the most important factors in mining site reclamation is to minimize damaging erosion and related adverse long-term environmental impacts of mining operations. In order to achieve the desirable goal of re-establishing productive use of the reclaimed land, it is necessary for the surface soil to support vegetation. One problem associated with the ability of the reclaimed land to support vegetation is the degree of compaction inherent in the replacement soil, which is often created by the reclamation operation itself.

One factor that significantly augments the degree of soil compaction is the weight of the earthmoving equipment used to replace and regrade the soil. As can be appreciated, such heavy equipment exerts a large surface pressure, thereby increasing soil compaction and density. These increases generally produce undesirable changes in the physical properties of the soil, which have seriously detrimental effects on water permeability and plant root growth. This translates directly into poor plant yields and plant stand establishment, which promotes erosion and associated environmental problems. Further, in severe cases, the incidence of dangerous mud or rock slides may result and this often causes related flooding problems.

Previously, others have proposed a variety of solutions to alleviate the problem of soil compaction created during such reclamation operations. One proposal involves the use of a large conveyor system to transport decompacted soil onto previously graded spoil, thereby providing a decompacted rooting layer for planting. Although this reduces the surface traffic caused by machinery and, thus, compaction, such a conveyor system is prohibitively expensive to install, maintain and operate.

Others have proposed the use of different methods of subsoil agitation. In one such method, "rippers" are provided which extend downwardly from the rear of a bulldozer into the soil. After the soil is graded by heavy machinery (which compacts the soil), a bulldozer having these rippers is driven over the compacted soil to agitate and decompact the same. Although such subsoil agitation reduces compaction temporarily, various studies show that subsoiling practices do not return the ability of the land to support vegetation back to the pre-mined state. Additionally, these studies demonstrate that the effects of such subsoiling operations are not permanent, generally lasting less than two years.

Thus, a need is identified for an improved apparatus that transforms compacted soil created during land reclamation operations to a more desirable condition promoting the growth of vegetation. The apparatus is preferably adapted for ready use on pre-existing equipment, thus avoiding expensive retrofitting. Furthermore, the apparatus should be relatively simple and inexpensive to operate and easy to maintain.

SUMMARY OF THE INVENTION

It is a primary object of the present invention to provide a soil regeneration apparatus for use with an earthmover and a related method that alleviates soil compaction.

Another object of the invention is to provide an apparatus for an earthmover that collects compacted soil, thoroughly processes and decompacts the soil, and deposits the decompacted soil in a controlled fashion transverse to the earthmover.

Still another object of the invention is to provide an apparatus that can selectively control the amount and depth of decompacted soil that is deposited, thereby providing a substantially level and decompacted rooting layer.

A further object of the present invention is to provide an apparatus that is easily and efficiently mounted on existing earthmoving equipment, thereby decreasing the expense associated with soil regeneration.

Yet another object of the present invention is to provide an apparatus that easily incorporates amendments into the decompacted soil to improve the character of the soil.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a soil regeneration apparatus for use with an earthmover is provided. In the preferred embodiment, the apparatus is designed for removable installation on an earthmover having a front-mounted blade for collecting/pushing earth, such as a bulldozer or tractor. The apparatus includes an auger rotatably mounted adjacent to the blade for decompacting and moving earth in a transverse direction relative to the blade. In accordance with an important aspect of the invention, the auger is longer than the blade and is mounted such that one end is affixed adjacent to an end of the blade, while the opposite end is secured in a mount positioned outside of the blade. Additionally, an actuator is connected to the auger, thereby allowing its vertical position relative to the blade to be selectively adjusted by the operator of the earthmover.

In accordance with another important aspect of the present invention, a lateral baffle is mounted adjacent to the side of the blade from which the auger extends. This baffle is mounted to extend from a fixed end of the blade. One or more actuators allow the operator to control the position of the baffle relative to the blade, which in turn controls the effective transverse dimension of the blade. This advantageously allows the operator to control the amount of soil deposited and the form of the resulting berm.

To promote efficiency, the soil regeneration apparatus is easily mounted on existing earthmoving equipment without necessitating expensive retrofitting. This includes providing an auxiliary motor for rotating the auger. Alternatively, the apparatus may include a power take-off so that the auger may be hydraulically driven by the earthmover itself.

During reclamation operations, after grading spoil over the excavation site, compacted soil is deposited in parallel windrows by a truck, scraper or the like. An earthmover equipped with the apparatus of the present invention is then driven into each windrow, thereby causing soil to collect and lift along the face of the blade. As this compacted soil rises, it reaches the rotating auger, which vigorously grinds and decompacts the soil. Preferably, and as noted above, the vertical position of the auger is selectively adjustable relative to the top of the blade. Thus, during operation, the auger can be raised or lowered periodically as desired to compensate for differences in the amount of soil encountered in the windrow as it raises against the face of the blade.

As can be appreciated, the rotation of the auger causes the now decompacted soil to be transversely displaced to a position outside of the blade. As the soil travels outside of the blade, it is deposited atop the previously graded spoil, thereby advantageously providing a decompacted rooting layer that is ideal for planting vegetation. As the soil is displaced transverse to the direction of travel, it does not support surface traffic of heavy earthmoving vehicles. As a result, the concomitant compaction that is characteristic of prior art methods, such as backfilling, is advantageously avoided.

Further, the lateral baffle advantageously allows the operator to control the amount and form of the soil deposited. Specifically, because the level of soil encountered in the windrows is non-constant, the amount of decompacted soil that is deposited may vary. This creates an unlevel berm which will require additional effort to level. To avoid this, the position of the baffle may be adjusted to effectively shorten or lengthen the blade. When less soil is available, the blade is lengthened to decrease the relative size of the fill zone that receives soil so that filling takes place without the formation of depressions. When more soil is available, the blade is shortened to increase the relative size of the fill zone so that a greater volume of soil is accumulated without mounding.

In accordance with another important aspect of the present invention, a method of regenerating compacted soil with an earthmover is also provided. This method includes the steps of collecting compacted earth, processing the compacted earth to provide decompaction, transversely displacing the decompacted earth relative to the earthmover, and controlling the level of the decompacted earth deposited adjacent to the path followed by the earthmover. In order for the method to provide for substantially even distribution of the decompacted earth, the compacted earth is ideally deposited in parallel windrows. Also, the method may also include the step of placing amendments in the windrows to enhance the structure and composition of the earth once it is decompacted.

Still other objects of the present invention will become apparent to those skilled in this art from the following description wherein there is shown and described a preferred embodiment of this invention, simply by way of illustration of one of the modes best suited to carry out the invention. As will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated into and forming a part of this specification, illustrates several aspects of the present invention and, together with the description, serves to explain the principles of the present invention. In the drawings:

FIG. 4*a* is a cutaway top view similar to FIG. 3*a*, showing the lateral baffle in an extended position, thereby decreasing the fill zone beside the blade and under the auger for soil deposition; and FIG. 4*b* is a similar top view, but showing the lateral baffle in a retracted position to increase the fill zone beside the blade and under the auger for soil deposition.

Reference will now be made in detail to the present preferred embodiment of the invention, an example of which is illustrated in the accompanying drawings.

DETAILED DESCRIPTION OF THE INVENTION

Figure 1:
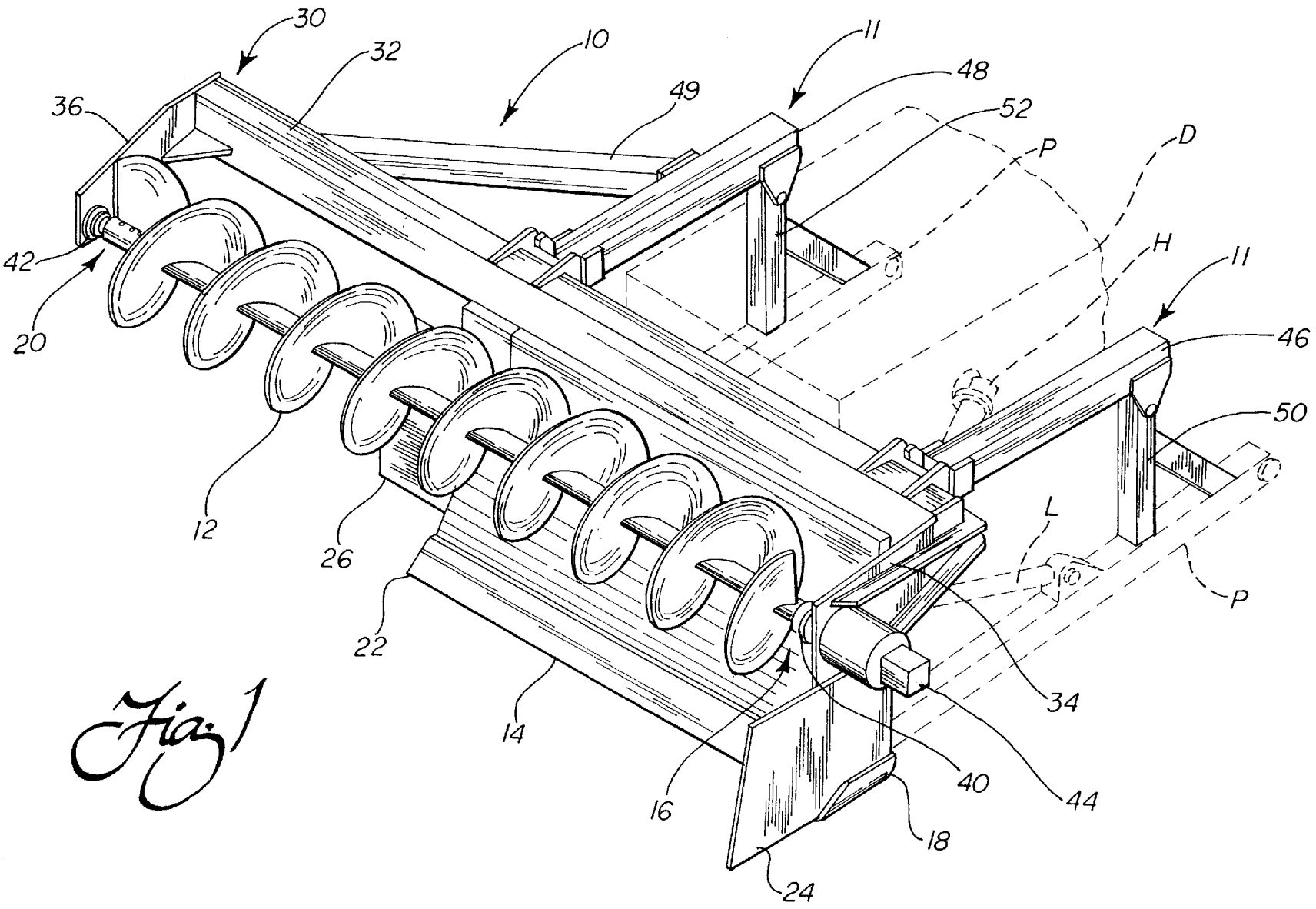
FIG. 1 is a perspective view of the soil regeneration apparatus of the present invention installed on a bulldozer, showing the transverse auger mounted above and forward of the blade and partially showing the controllable lateral baffle.

Reference is now made to FIG. 1, showing a soil regeneration apparatus 10 constructed in accordance with the principles of the present invention. The apparatus 10 is shown attached to the front end of a bulldozer D to illustrate an environment for which the present apparatus may be adapted. However, modification of the apparatus 10 for use on other types of earthmovers having a front-mounted blade or the like, such as a tractor, is also contemplated. As illustrated, the apparatus 10 is removably secured to the bulldozer D through suitable mounting means 11, as will be explained in more detail below.

In the preferred embodiment, the apparatus 10 includes a rotatable helicoid auger 12 that is longer than the blade 14 of bulldozer D. As can be appreciated from viewing FIG. 1, this auger 12 is mounted in a substantially horizontal plane above, forward of and parallel to the blade 14. Thus, the auger 12 is mounted transverse to the direction of travel of the bulldozer D. More particularly, a first end 16 of the auger 12 is rotatably mounted above the blade 14 at or near a selected first side 18. The second, or opposite, end 20 of the auger 12 is likewise rotatably mounted, such that it extends beyond the second, or opposite, side 22 of the blade 14. Of course, this mounting position may be reversed, if desired, such that the auger 12 extends from first side 18 and is mounted adjacent to second side 22.

As should now be appreciated, the blade 14 collects and pushes earth as the bulldozer D is driven forward. This function is assisted by a fixed transverse baffle 24 which forces the soil (not shown) to rise against the front face of the blade 14, rather than spilling from side 18. As will be described in more detail below, an adjustable lateral baffle 26 is also provided adjacent the opposite side 22 of the blade 14 for selectively controlling the form and amount of soil deposited by the auger 12.

The ends of the auger 16, 20 are mounted to either side of a support frame, generally designated by the reference numeral 30. This support frame 30 includes an elongated tubular steel cross bar 32 fixedly attached to the mounting means 11. Two mounting brackets 34, 36 extend transversely from the ends of the crossbar 32, one adjacent the first side 18 and the other adjacent the second side 22 of blade 14. These mounting brackets 34, 36 are provided with mounts 40, 42 for rotatably holding the ends of the auger shaft 16, 20.

A driver 44 for driving the auger 12 is preferably attached to the end of auger shaft 16. As illustrated, the driver 44 is a direct drive motor having an independent power source (not shown). However, the apparatus 10 may include a hydrostatic transmission (not shown) driven by a power take-off of the bulldozer or other means so that the auger may be hydraulically driven.

As noted above, mounting means 11 support the frame 30. More particularly, the mounting means 11 include two arms 46, 48 that are secured to crossbar 32 through a mechanical attachment, such as a pinned connection. The opposite ends of these arms 46, 48 are pivotally connected to corresponding upstanding posts 50, 52, which are attached directly to each respective push arm P. Each push arm P is attached to the blade 14 and allows its angular position to be adjusted. An additional support arm 49 is optionally provided between arm 48 and frame 30 for assisting in supporting the portion of the frame/auger that extends from the fixed end 22 of the blade 14.

Figure 2:
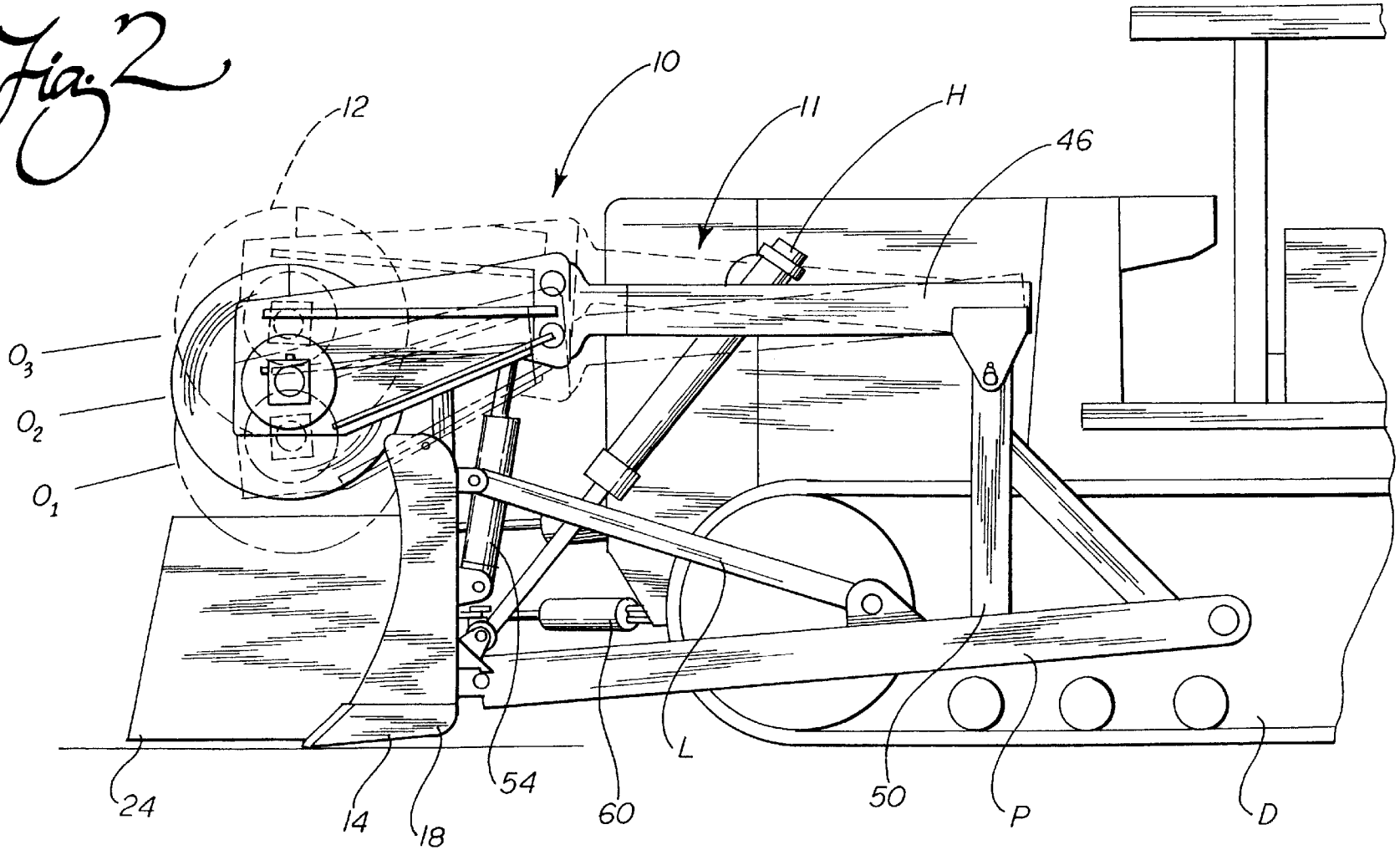
FIG. 2 is a side view of the apparatus, showing the selective adjustment of the vertical position of the auger relative to the top of the blade.

Referring now to FIG. 2, an actuator 54, shown for purposes of illustration as a hydraulic cylinder, is attached to the rear of the blade 14 (more than one cylinder could be used). The end of the piston (not shown) extending from the cylinder 54 is attached to the arms 46, 48. As should now be appreciated, this hydraulic cylinder 54 and the two upstanding posts 50, 52 are the only connections between the apparatus 10 and the bulldozer D. This minimum number of connections advantageously allows the apparatus 10 to be easily installed and removed. Furthermore, the apparatus 10 does not interfere with the existing operative means of the bulldozer D, such as the hydraulic piston H used to adjust the position of the blade 14 or the linking arm L that supports the blade 14.

As further illustrated, the pivoting connections made between the arms 46, 48 and the posts 50, 52 in conjunction with the lifting force provided by the hydraulic cylinder/piston arrangement 54 provides the auger 12 with the ability to be raised and lowered relative to the blade 14 to selected vertical operating positions $O_1$, $O_2$, $O_3$. As will be described in more detail below, this feature, along with the controllable lateral baffle 26, allow adjustments to be made depending on the condition and size of the windrow or the desired form and amount of soil to be deposited.

Figures 3A, 3B:
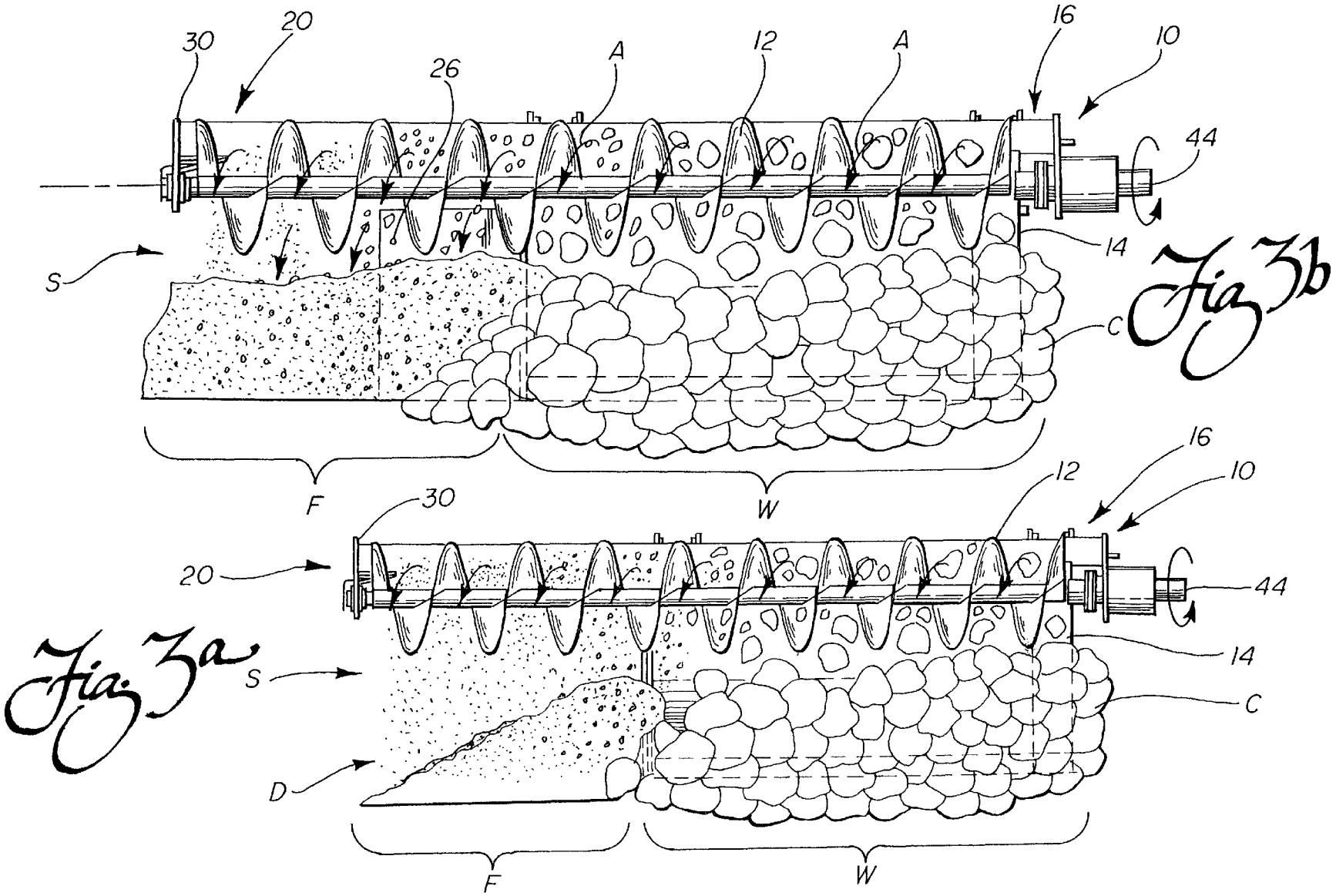
FIG. 3*a* is a front view showing the operation of the apparatus of the present invention, including the blade collecting the compacted soil placed in a windrow, the soil raising against the blade until it reaches the auger, the auger vigorously grinding, decompacting, and transversely displacing the soil, with the lateral baffle in a retracted position.
FIG. 3*b* is a similar view showing the lateral baffle in an extended position.

Referring now to FIGS. 3*a* and 3*b*, the operation of the apparatus 10 is now explained in detail. As previously noted, after spoil is graded over the excavation site, trucks or scrapers (not shown) deposit compacted soil in one or more windrows W extending along the reclamation area wherein the decompacted soil is desired. Preferably, these windrows W are placed along imaginary lanes parallel to the edge of the land being reclaimed. Of course, the first of such lanes is preferably not filled with compacted soil, as the second lane is used to fill the first lane.

As illustrated in FIG. 3*a*, a bulldozer which includes the soil regeneration apparatus 10 of the present invention is driven forward into the windrow W, along its longitudinal axis. Of course, as the blade 14 is pushed into the windrow W, the compacted clumps of soil C rise against the face of the blade until they reach the auger 12. As shown by the action arrows A, the auger 12 is rotated by direct drive motor 44 in a counter-clockwise direction at a pre-determined ideal speed over a controllable and variable speed range. Thus, as the top of the windrow W contacts the rotating helicoid blade of the auger 12, it is vigorously ground and decompacted. Also, as the auger 12 continues to rotate, the now decompacted soil is carried laterally (from right to left in FIG. 3a) and transverse to the direction of travel (toward the viewer). As the newly decompacted soil of windrow W is moved by the auger 12 past the fixed end 22 of the blade 14 the soil is deposited in the fill zone F. Thus, a layer of decompacted soil is formed transverse to and outside of the path of bulldozer travel. Advantageously, this transverse displacement avoids further compaction by the bulldozer itself. Multiple passes of the apparatus 10 along parallel windrows provide a deep, substantially decompacted rooting layer that is ideal for planting vegetation or the like.

In accordance with another aspect of the present invention, an adjustable lateral baffle 26 is provided for controlling the amount and form of the soil deposited by the auger 12 in the fill zone F. In the preferred embodiment, the baffle 26 is hingedly attached and extends parallel from the fixed end 22 of the blade 14 adjacent the extended portion of the auger 12. One or more actuators 60, shown for purposes of illustration in FIGS. 4*a* and 4*b* as hydraulic cylinders, are provided for selectively adjusting the position of the baffle 26, as is described in more detail below. Although the baffle 26 is preferably hingedly attached to the blade 14, thereby allowing it to pivot angularly about the fixed end of the blade in a limited fashion, other types of attachments that provide similar results, such as a sliding baffle, are also considered to fall within the scope of this invention.

As described above, decompacted soil S is transversely displaced along auger 12 until it reaches a position external to blade 14 within the fill zone F, where it is deposited. The desired result is to produce a substantially level berm of decompacted soil in the fill zone F. However, as should be appreciated, the volume of soil in the windrow W is likely to vary as a result of physical forces that affect the delivery equipment during the soil dumping operation. If the volume of compacted soil decreases as the bulldozer D moves along the windrow W, the amount of compacted soil C being fed into auger 12 likewise decreases. This inevitably reduces the amount of soil S being transversely displaced, which creates an undesirable depression D at or near the end of the fill zone F. This depression creates an uneven and unlevel berm (see FIG. 3*a*). If this depression is subsequently filled with the use of heavy machinery operating on the surface of the deposited soil, undesirable compaction will occur. Accordingly, the elimination of the formation of depressions is desired.

To avoid the creation of this depression D, and the necessity of additional leveling, the lateral baffle 26 is extended to a position parallel with blade 14 (see FIGS. 3*b* and 4). This, of course, decreases the effective volume of the fill zone F. In this position, much of the soil that would have been deposited raises against the baffle 26 as the bulldozer D is driven forward. The decompacted soil S collected against the baffle 26 advantageously prevents soil conveyed along the auger 12 from falling and collecting adjacent the blade 14. This, in turn, causes the decompacted soil S to travel further to the end of the auger 12 before it is deposited, thereby filling the outer edge of the fill zone F to the desired level and eliminating any depression.

If the amount of compacted soil in the windrow W increases, the baffle 26 is retracted to a selected position (see FIG. 4*b*) to shorten the effective transverse dimension of the blade 14 and thereby increase the relative volume of the fill zone F. Thus, a greater volume of soil S is accumulated in the fill zone F without mounding.

Of course, it should be appreciated that the volume of compacted soil C in windrow W is constantly changing. Thus, the operator of the bulldozer D continuously adjusts the angular position of the infinitely adjustable baffle 26 and, thus, the effective transverse dimension of the blade 14, during operation to provide a substantially uniform berm regardless of changes in the volume of compacted soil in the window W. Providing an automatic sensor (not shown) on the apparatus 10 to detect the berm conditions and adjust the baffle 26 is accordingly contemplated. Furthermore, to finely adjust the amount of compacted soil being deposited, the vertical position of the auger 12 may also be selectively adjusted between positions $O_1$, $O_2$ and $O_3$ (see FIG. 2). In effect, the goal is to control the depth of the fill zone F and to tune the volume of the fill zone to match the volume of soil being processed and delivered by the auger 12 from the windrow. This allows one to meet any grade requirements that might be set under the reclamation law.

In accordance with another important aspect of the present invention, a method of regenerating compacted soil with an earthmover is also provided. This method includes the steps of collecting compacted earth, processing the compacted earth to provide decompaction, transversely displacing the decompacted earth relative to the earthmover, and controlling the level of the decompacted earth deposited adjacent to the path followed by the earthmover. In order for the method to provide for substantially even distribution of the decompacted earth, the compacted earth is ideally deposited in parallel windrows. Also, to further increase the ability of the decompacted soil to support vegetation, the method also includes the step of adding soil amendments, such as fertilizer, manure or the like, to the windrows W of compacted soil C. Of course, the action of the helicoid auger 12 assists in incorporating and evenly dispersing these amendments into the soil S, which further improves the ability of the soil to support vegetation.

In summary, an apparatus 10 for regenerating compacted soil C for use in land reclamation operations is provided. The apparatus 10 includes an auger 12 rotatably mounted forward of the blade 14 of an earthmover, such as a bulldozer D. Furthermore, the auger 12 is longer than the blade 14, and is mounted such that it extends beyond an end of the blade (FIG. 1). Adjacent this extension of the auger 12, a controllable lateral baffle 26 is mounted (FIG. 1). In operation, compacted soil C is collected by the blade 14 until it reaches the auger 12, which decompacts, transversely displaces, and ultimately deposits the soil adjacent the blade 14 in the fill zone F (see FIGS. 3*a* and 3*b*). In accordance with another aspect of the present invention, the lateral baffle 26 may be selectively adjusted to control the level of decompacted soil deposited in this fill zone F. This allows for a substantially level decompacted rooting layer to be formed that is ideal for planting vegetation or the like.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. a regeneration apparatus for use on an earthmover, comprising:

a blade for collecting earth;

an auger mounted on said blade for decompacting and moving earth transversely relative to said blade;

a driver for driving said auger; and a lateral baffle mounted to said blade and selectively displaceable to adjust an effective transverse dimension of said blade.

2. The regeneration apparatus according to claim 1, wherein said earthmover is a bulldozer.

3. The regeneration apparatus according to claim 1, wherein said driver includes an auxiliary motor for rotating said auger.

4. The regeneration apparatus according to claim 1, including a first actuator connected to said lateral baffle for selectively displacing said lateral baffle between fully extended and fully retracted positions.

5. The regeneration apparatus according to claim 4, wherein said lateral baffle is hinged to said blade.

6. The apparatus according to claim 4, further including a second actuator connected to said auger for selectively vertically displacing said auger relative to said blade.

7. The apparatus according to claim 1, wherein said auger is longer than said blade.

8. An apparatus for alleviating compaction in surface layers of earth comprising:

an earthmover having a blade for collecting the earth;

an auger mounted on said blade for decompacting and moving the earth transversely relative to said blade;

a driver for driving said auger; and a lateral baffle mounted to said blade and selectively displaceable to adjust an effective transverse dimension of said blade.

9. The apparatus according to claim 8, wherein said auger driver includes an auxiliary motor for rotating said auger.

10. The apparatus according to claim 9, including a first actuator connected to said lateral baffle for selectively displacing said lateral baffle between fully extended and fully retracted positions.

11. The apparatus according to claim 10, wherein said lateral baffle is hinged to said blade.

12. The apparatus according to claim 8, wherein said auger is longer than said blade.

13. The apparatus according to claim 8, including a second actuator connected to said auger for selectively vertically displacing said auger relative to said blade.

14. A regeneration apparatus for use on an earthmover, comprising:

means for collecting earth;

means for decompacting and moving earth transversely relative to said collecting means;

means for driving said decompacting and moving means; and means for selectively controlling the level of earth deposited adjacent to the path of the earthmover.

15. A regeneration apparatus for use on an earthmover, comprising:

a blade for collecting earth;

an augar rotatably mounted at the top of the blade and extending past at least one side edge of the blade substantially above a grade level; and a driver for driving said auger, wherein said auger serves the dual functions of decompacting and transversely moving earth collected by said blade such that said decompacted earth is deposited in a substantially level berm adjacent said at least one side of the blade.

16. The regeneration apparatus according to claim 15, further including a lateral baffle mounted to said blade and selectively displaceable to adjust an effective transverse dimension of said blade.

17. The regeneration apparatus according to claim 15, wherein the vertical position of said auger relative to said blade is selectively adjustable.

* * * * *

UNITED STATES PATENT AND TRADEMARK OFFICE

CERTIFICATE OF CORRECTION

PATENT NO : 6,056,066

DATED : May 2, 2000

INVENTOR(S) : Larry G. Wells; John P. Fulton

It is certified that error appears in the above-identified patent and that said Letters Patent is hereby corrected as shown below:

Claim 8, Column 8, line 45, between the words "earth" and "comprising" insert a - - , - -.

Claim 15, Column 9, line 11, change "augar" to - - auger - -.

Signed and Sealed this

Tenth Day of April, 2001

*Attest:*

Nicholas P. Godici

NICHOLAS P. GODICI

*Attesting Officer*

*Acting Director of the United States Patent and Trademark Office*